United States Patent [19]

Masaki et al.

[11] 4,060,983

[45] Dec. 6, 1977

[54] EXHAUST GAS REBURNING DEVICE

[75] Inventors: Kenji Masaki, Yokohama; Hatuo Nagaisi, Yokosuka, both of Japan

[73] Assignee: Nissan Motor Co., Ltd., Yokohama, Japan

[21] Appl. No.: 603,916

[22] Filed: Aug. 12, 1975

[30] Foreign Application Priority Data

Aug. 13, 1974 Japan ..... 49-92642

[51] Int. Cl.[2] ..... F01N 3/10

[52] U.S. Cl. ..... 60/282; 60/323

[58] Field of Search ..... 60/282, 285, 323, 302

[56] References Cited

U.S. PATENT DOCUMENTS

| | | | |
|---|---|---|---|
| 3,247,666 | 4/1966 | Behrens | 60/302 |
| 3,413,803 | 12/1968 | Rosenlund | 60/282 |
| 3,785,153 | 1/1974 | Schwing | 60/282 |
| 3,827,237 | 8/1974 | Linder | 60/285 |
| 3,934,411 | 1/1976 | Masaki | 60/282 |

*Primary Examiner*—Douglas Hart

[57] ABSTRACT

An exhaust gas reburning device has inlet ports communicating respectively with the exhaust ports of half of the combustion chambers of an engine and opening into the reaction chamber, and passageways which communicate respectively with the exhaust ports of the combustion chambers adjoining the half of the combustion chambers and fed with a combustible mixture having an air-fuel ratio different from that of a combustible mixture fed thereinto and which extend respectively to the axes of the inlet ports in the reaction chamber.

3 Claims, 1 Drawing Figure

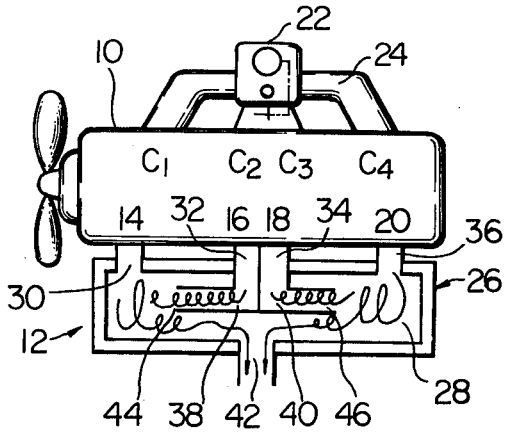
22
10
24
C1
C2
C3
C4
14
32
16
18
34
20
36
30
26
12
28
44
38
42
40
46

EXHAUST GAS REBURNING DEVICE

The present invention relates generally to an exhaust gas purifying or reburning device for an internal combustion engine in which two groups of combustion chambers are fed respectively with relatively rich and lean air-fuel mixtures, and particularly to a novel and improved exhaust gas reburning device, for an internal combustion engine of this type, in which two differently composed exhaust gases emitted from the engine are sufficiently mixed with each other to satisfactorily oxidize burnable harmful constituents in the exhaust gases into harmless constituents.

As is well known in the art, in order to reduce the amount of nitrogen oxides (NOx) produced by the engine, it is desirable for the engine to employ a relatively rich or lean air-fuel mixture having an air-fuel ratio lower or higher than a stoichiometric air-fuel ratio. However, when the engine employs the relatively rich air-fuel mixture, although the engine can generate sufficient power, it is subjected to high fuel consumption and discharges exhaust gas containing relatively large amounts of burnable harmful components such as hydrocarbons and carbon monoxide. To the contrary, when the engine employs the relatively lean air-fuel mixture, although the engine discharges exhaust gas containing relatively small amounts of burnable harmful components, it produces insufficient power. As a result, the engine can not operate smoothly.

Thus, it has been proposed to supply a cylinder or some cylinders of the engine with the relatively rich air-fuel mixture and another cylinder or the remaining cylinders with the relatively lean air-fuel mixture. This technique has advantages in that the production of nitrogen (NOx) is reduced, that sufficient power and low fuel consumption are attained, and that a relatively large amount of air or oxygen contained in the exhaust gas resulting from combustion of the relatively lean air-fuel mixture is used for oxidation of the burnable harmful components in the exhaust gases in an exhaust gas reburning device such as a thermal reactor. However, a conventional exhaust gas reburning device has been unable to sufficiently mix relatively large amounts of burnable harmful components contained in exhaust gas resulting from combustion of the relatively rich air-fuel mixture with the relatively large amount of air or oxygen in the exhaust gas resulting from the combustion of the relatively lean air-fuel mixture and accordingly has been unable to sufficiently oxidize the burnable harmful components in the exhaust gases. As a result, the engine has discharged into the atmosphere exhaust gases containing large amounts of burnable harmful components.

It is, therefore, an object of the invention to provide a novel and improved exhaust gas reburning device which can sufficiently mix two kinds of differently composed exhaust gases resulting from combustion of the relatively rich and lean air-fuel mixtures to satisfactorily oxidize burnable harmful components in the exhaust gases into harmless components.

This and other objects and advantages of the invention will become more apparent from the following detailed description taken in connection with the accompanying drawing which is a schematic cross-sectional view of a preferred embodiment of an exhaust gas reburning device according to the invention.

Referring to the drawing, there is shown an internal combustion engine 10 and an exhaust gas reburning device or thermal reactor according to the invention combined with or incorporated into the exhaust system (no numeral) of the engine 10 and generally designated by the reference numeral 12. The engine 10 includes four cylinders $C_1$, $C_2$, $C_3$ and $C_4$ which have combustion chambers (no numeral) having exhaust ports 14, 16, 18 and 20, respectively, a carburetor 22, an intake manifold 24 leading from the carburetor 22 to the combustion chambers of the individual cylinders $C_1$ to $C_4$, and an exhaust gas passageway (not shown) which is vented through the thermal reactor 12 to the ambient atmosphere through a muffler or silencer (not shown). The carburetor 22 is constructed and arranged to feed a relatively rich air-fuel mixture having an air-fuel ratio lower than a predetermined air-fuel ratio such as, for example, a stoichiometric air-fuel ratio and a relatively lean air-fuel mixture having an air-fuel ratio higher than the predetermined air-fuel ratio and is combined with the engine 10 in such a way that the relatively lean air-fuel mixture is fed to the cylinders $C_1$ and $C_4$ while the relatively rich are-fuel mixture is fed to the cylinders $C_2$ and $C_3$.

The exhaust gas reburning device 12 comprises a housing or outer cylinder 26 having a reaction chamber 28 which is formed therein. The housing 26 is also formed with inlet ports 30, 32, 34 and 36, passageways 38 and 40, and an outlet port 42. The inlet ports 30 and 36 communicate respectively with the exhaust ports 14 and 20 of the engine 10 and each opens into the reaction chamber 28 to allow exhaust gases from the cylinders $C_1$ and $C_4$ to flow into the reaction chamber 28. The inlet ports 32 and 34 adjoin the inlet ports 30 and 36, respectively and communicate respectively with the exhaust ports 16 and 18 of the engine 10 to receive those exhaust gases from the cylinders $C_2$ and $C_3$ which are different in composition from the exhaust gases from the cylinders $C_1$ and $C_4$.

The passageways or inner cylinders 38 and 40 are located in the reaction chamber 28 and adjoin the inlet ports 30 and 36, respectively. The passageway or cylinder 38 is connected at one end to the inlet port 32 and extends at the other end toward an extension of an axis of the inlet port 30 in the direction of which extension the exhaust gas from the inlet port 30 flows. The passageway or cylinder 40 is connected at one end to the inlet port 34 and extends at the other end toward an extension of an axis of the inlet port 36 in the direction of which extension the exhaust gas from the inlet port 36 flows. The passageways 38 and 40 have outlet portions 44 and 46 which extend or are directed perpendicular or lateral to the directions of the axes of the inlet ports 30 and 36 and close to the inlet ports 30 and 36, respectively. The passageways 38 and 40 guide or carry the exhaust gases from the inlet ports 32 and 34 to the flows of the exhaust gases from the inlet ports 30 and 36 or to positions close to the inlet ports 30 and 36 in such a manner that the exhaust gases from the inlet ports 32 and 34 strike against or meet with and are sufficiently or satisfactorily mixed with the exhaust gases from the inlet ports 30 and 36, respectively. It is desirable or important to select the arrangement of two groups of cylinders or combustion chambers, supplied respectively with relatively lean and rich air-fuel mixtures, of an engine combined with an exhaust gas reburning device according to the invention, the ignition sequence of the cylinders or combustion chambers of the engine, and the arrangement of passageways and inlet ports, cooperating with or adjoining the passageways, of a reaction chamber of the exhaust gas reburning device in such a manner that the exhaust gases fed through the passageways completely or satisfactorily meet respectively with the flows of exhaust gases fed directly from the adjoining inlet ports into the reaction chamber. For this purpose, it is desirable or necessary for the engine 10 combined with the exhaust gas reburning device 12 illustrated in the drawing that the air-fuel mixtures fed into the cylinders $C_1$ and $C_4$ are ignited or burned next to the air-fuel mixtures fed into the cylinders $C_2$ and $C_3$ since the exhaust gases from the cylinders $C_2$ and $C_3$ require time for passing through the passageways 38 and 40 to approach the flows of exhaust gases from the inlet ports 30 and 36, respectively. Thus, it is desirable for the engine 10 of the combination illustrated that the ignition sequence of the four cylinders $C_1$ to $C_4$ is $C_3$-$C_4$-$C_2$-$C_1$. The outlet port 42 is connected to the exhaust gas passageway of the engine 10 to discharge the exhaust gases thereinto which have been reburned or purified in the reaction chamber 28.

In order to effectively utilize the heat of two kinds of differently composed exhaust gases from the engine 10 for the oxidation of the exhaust gases in the reaction chamber 28, it is preferable that the inlet ports of the exhaust gas reburning device 12 communicate respectively with the individual exhaust ports of the engine 10 at positions immediately downstream of the exhaust ports and that accordingly the exhaust gas reburning device 12 is disposed parallel to the length of the engine 10, as shown in the drawing. Since the exhaust gas reburning device 12 has the inlet ports communicating respectively with every exhaust port of the engine 10, the length of the exhaust gas reburning device 12 is approximately equal to that of the engine 10, as shown in the drawing. The inlet ports 30 and 36 directly opening into the reaction chamber 28 are located remote from the outlet port 42 in such a way as to increase or maximize the staying time of the exhaust gases from the inlet ports 30 and 36 in the reaction chamber 28.

The exhaust gas reburning device thus far described operates as follows.

It is assumed that the ignition sequence of the cylinders $C_1$ to $C_4$ of the engine 10 is $C_3$-$C_4$-$C_2$-$C_1$. When the engine 10 operates, the relatively rich air-fuel mixture is burned in the cylinders $C_2$ and $C_3$ to discharge exhaust gas which contains relatively large amounts of unburned or incompletely burned harmful components such as hydrocarbons and carbon monoxide while the relatively lean air-fuel mixture is burned in the cylinders $C_1$ and $C_4$ to discharge exhaust gas which contains a relatively large amount of air or oxygen.

The exhaust gas from the cylinder $C_3$ is guided from the inlet port 34 into the reaction chamber 28 close to the inlet port 36 by the passageway 40. Next to the exhaust gas from the cylinder $C_3$, the exhaust gas from the cylinder $C_4$ is discharged into the reaction chamber 28 from the inlet port 36. As a result, the exhaust gas from the passageway 40 strikes against the exhaust gas from the inlet port 36, and hydrocarbons and carbon monoxide in the exhaust gas from the cylinder $C_3$ are sufficiently mixed and reacted with air or oxygen in the exhaust gas from the cylinder $C_4$.

Next to the exhaust gas from the cylinder $C_4$, the exhaust gas from the cylinder $C_2$ is guided from the inlet port 32 into the reaction chamber 28 close to the inlet port 30 by the passageway 38. Next to the exhaust gas from the cylinder $C_2$, the exhaust gas from the cylinder $C_1$ is discharged from the inlet port 30 into the reaction chamber 28. As a result, the exhaust gas from the passageway 38 strikes against the exhaust gas from the inlet port 30, and hydrocarbons and carbon monoxide in the exhaust gas from the cylinder $C_2$ are sufficiently mixed and reacted with air or oxygen in the exhaust gas from the cylinder $C_1$. Thus, burnable harmful components in the exhaust gases discharged from the engine 10 are oxidized and rendered harmless. Accordingly, the amounts of harmful components discharged from the engine 10 into the ambient atmosphere are minimized or reduced, for example, even to zero.

Although the exhaust gas reburning device according to the invention has been described as being applied to an engine employing a carburetor, the exhaust gas reburning device can be applied to an engine of the fuel injection type which includes as combustible mixture feeding means in place of a carburetor an induction passageway leading from the atmosphere to an engine combustion chamber for feeding air thereinto and a fuel injector for injecting fuel into the air fed by the induction passageway.

Although the invention has been also described as being applied to an engine of a piston-cylinder type, the invention can be applied to an engine of a rotary type.

Although the exhaust gas reburning device has been also described such that the inlet ports 30 and 36 followed by no passageways are connected to the combustion chambers fed with a relatively lean air-fuel mixture and the inlet ports 32 and 34 followed respectively by the passageways 38 and 40 are connected to the combustion chambers fed with a relatively rich air-fuel mixture, the exhaust gas reburning device can be combined with the engine in such a manner that the inlet ports 30 and 36 are connected to the combustion chambers fed with a relatively rich air-fuel mixture and the inlet ports 32 and 34 are connected to the combustion chambers fed with a relatively lean air-fuel mixture. It is important that an inlet port followed by no passageway and an adjoining inlet port followed by a passageway are fed respectively with two exhaust gases having compositions different from each other.

What is claimed is:

1. An exhaust gas reburning device for an internal combustion engine, comprising a reaction chamber having first, second, third and fourth inlet ports each opening into said reaction chamber to admit exhaust gas of said engine thereinto, said second and third inlet ports being interposed between said first and fourth inlet ports and adjoining each other, first and second cylinders each located in said reaction chamber, said first cylinder being connected at one end to said second inlet port and extending at the other end toward an extension of an axis of said first inlet port in the direction of which extension said exhaust gas from said first inlet port flows into said reaction chamber to strike against exhaust gas flow from said first cylinder, said second cylinder being connected at one end to said third inlet port and extending at the other end toward an extension of an axis of said fourth inlet port in the direction of which extension said exhaust gas from said fourth inlet port flows into said reaction chamber to strike against exhaust gas flow from said second cylinder, and an outlet port opening from said reaction chamber at a nearly equal distance from said first and fourth inlet ports outside said reaction chamber.

2. An exhaust gas reburning device as claimed in claim 1, in which said first and second cylinders have outlet portions directed perpendicularly to the directions of said axes of said first and fourth inlet ports, respectively.

3. An exhaust gas reburning device in combination with an internal combustion engine including first, second, third and fourth combustion chambers, and a combustible mixture forming device for forming a first air-fuel mixture for said first and fourth combustion chambers and a second air-fuel mixture for said second and third combustion chambers, one of said first and second air-fuel mixtures having an air-fuel ratio higher than a stoichiometric air-fuel ratio and the other air-fuel mixture having an air-fuel ratio lower than said stoichiometric air-fuel ratio, said exhaust gas reburning device comprising a reaction chamber having first, second, third and fourth inlet ports communicating respectively with said first, second, third and fourth combustion chambers and each opening into said reaction chamber to admit exhaust gases of said combustion chamber thereinto, said second and third inlet ports being interposed between said first and fourth inlet ports and adjoining each other, first and second cylinders each located in said reaction chamber, said first cylinder being connected at one end to said second inlet port and extending at the other end toward an extension of an axis of said first inlet port in the direction of which extension said exhaust gas from said first inlet port flows into said reaction chamber to strike against exhaust gas flow from said first cylinder, said second cylinder being connected at one end to said third inlet port and extending at the other end toward an extension of an axis of said fourth inlet port in the direction of which extension said exhaust gas from said fourth inlet port flows into said reaction chamber to strike against exhaust gas flow from said second cylinder, and an outlet port opening from said reaction chamber at a nearly equal distance from said first and fourth inlet ports outside said reaction chamber.

* * * * *